US011342711B2

(12) United States Patent
Schambach et al.

(10) Patent No.: US 11,342,711 B2
(45) Date of Patent: May 24, 2022

(54) CONNECTOR WITH AN EXTENDABLE LEVER ASSEMBLY

(71) Applicant: TE Connectivity Germany GmbH, Bensheim (DE)

(72) Inventors: Michael Schambach, Dortmund (DE); Stefan Plotz, Iserlohn (DE); Tobias Leininger, Mannheim (DE); Gunter Feldmeier, Lorsch (DE); Martin Szelag, Bickenbach (DE); Franz Mueller, Griesheim (DE); Ole Wiborg, Mainz (DE)

(73) Assignee: TE Connectivity Germany GmbH, Bensheim (DE)

( * ) Notice: Subject to any disclaimer, the term of this patent is extended or adjusted under 35 U.S.C. 154(b) by 27 days.

(21) Appl. No.: 16/902,689

(22) Filed: Jun. 16, 2020

(65) Prior Publication Data

US 2020/0313352 A1 Oct. 1, 2020

Related U.S. Application Data

(63) Continuation of application No. PCT/EP2018/082593, filed on Nov. 26, 2018.

(30) Foreign Application Priority Data

Dec. 27, 2017 (DE) ..... 10 2017 223 810.0

(51) Int. Cl.
*H01R 13/629* (2006.01)
*H01R 13/6597* (2011.01)

(52) U.S. Cl.
CPC . *H01R 13/62966* (2013.01); *H01R 13/62961* (2013.01); *H01R 13/6597* (2013.01)

(58) Field of Classification Search
CPC ..... H01R 13/62966; H01R 13/62961; H01R 13/6597; H01R 13/62972; H01R 13/582; H01R 13/5825; H01R 13/5829
See application file for complete search history.

(56) References Cited

U.S. PATENT DOCUMENTS 5,474,465 A * 12/1995 Kobayashi ..... H01R 13/6275 439/278
5,810,612 A 9/1998 Flask et al.
(Continued)

FOREIGN PATENT DOCUMENTS

CN 2686143 Y 3/2005
DE 19702836 A1 7/1997
(Continued)

OTHER PUBLICATIONS

First Office Action from the JPO in Appln. No 2020-534894, dated Jun. 22, 2021, and English translation thereof, 10 pp.
(Continued)

*Primary Examiner* — Renee S Luebke
*Assistant Examiner* — Paul D Baillargeon
(74) *Attorney, Agent, or Firm* — Barley Snyder

(57) ABSTRACT

A connector includes a connector housing having a coupling side for coupling with a complementary connector along a connection direction and a lever assembly including a lever for coupling with the complementary connector. The lever is pivotable around an axis of rotation on the connector housing. The axis of rotation extends essentially perpendicular to the connection direction. The lever extends in at least one position in the connection direction away from the axis of rotation toward the coupling side. The lever assembly has an extension that is movable relative to the lever and that extends the lever assembly in an extended state away from the axis of rotation.

24 Claims, 7 Drawing Sheets

(56) References Cited

U.S. PATENT DOCUMENTS

| | | | | |
|---|---|---|---|---|
| 5,829,994 | A * | 11/1998 | Oda | H01R 13/62944 439/157 |
| 7,361,036 | B2 * | 4/2008 | Pittenger | H01R 13/62977 439/157 |
| 8,033,844 | B2 * | 10/2011 | Kobayashi | H01R 13/62955 439/157 |
| 9,692,153 | B1 | 6/2017 | Rodriquez et al. | |
| 2020/0313352 | A1 | 10/2020 | Schambach et al. | |

FOREIGN PATENT DOCUMENTS

| | | | |
|---|---|---|---|
| DE | 102006045155 | A1 | 4/2008 |
| DE | 102017223810 | B3 | 3/2019 |
| EP | 3226361 | A1 | 10/2017 |
| FR | 3017003 | A1 | 1/2014 |
| JP | 11329579 | A | 11/1999 |
| JP | 2001135371 | A | 5/2001 |

OTHER PUBLICATIONS

Abstract of JPA2001135371, 1 p.
Second Office Action and English translation, Appln. No. 2018/80083049.4, dated Jul. 15, 2021, 17 pages.
Abstract of JPH11329579, dated Nov. 30, 1999, 1 page.
Abstract of CN2686143, dated Mar. 16, 2005, 1 page.
PCT Notification, The International Search Report and the Written Opinion of the International Searching Authority, dated Feb. 13, 2019, 14 pages.
European Patent Office Communication, App. No. 18 808 350.5-1201, dated Feb. 3, 2022, 7 pages.

* cited by examiner

CONNECTOR WITH AN EXTENDABLE LEVER ASSEMBLY

CROSS-REFERENCE TO RELATED APPLICATIONS

This application is a continuation of PCT International Application No. PCT/EP2018/082593, filed on Nov. 26, 2018, which claims priority under 35 U.S.C. § 119 to German Patent Application No. 102017223810.0, filed on Dec. 27, 2017.

FIELD OF THE INVENTION

The present invention relates to a connector and, more particularly, to a connector with an extendable lever assembly.

BACKGROUND

Connectors or complementary connectors comprise a plurality of wires that are terminated in contact pins, which in turn have to be inserted into a socket of a complementary connector or connector, respectively. With an increasing amount of single contact pins, the plug-in force that is necessary for coupling the connector with the complementary connector also increases. Furthermore, in the application of common connectors, such as insulation displacement connectors, in which the insulation of the wire is displaced by the connector, a high plug-in force is necessary.

The high plug-in force may lead to the user not being able to couple the connector with the complementary connector. In limited space in particular, the handling becomes more difficult and, consequently, so does the coupling of the connector and/or complementary connector. Furthermore, it is desirable that the connector takes up as little space as possible.

SUMMARY

A connector includes a connector housing having a coupling side for coupling with a complementary connector along a connection direction and a lever assembly including a lever for coupling with the complementary connector. The lever is pivotable around an axis of rotation on the connector housing. The axis of rotation extends essentially perpendicular to the connection direction. The lever extends in at least one position in the connection direction away from the axis of rotation toward the coupling side. The lever assembly has an extension that is movable relative to the lever and that extends the lever assembly in an extended state away from the axis of rotation.

BRIEF DESCRIPTION OF THE DRAWINGS

The invention will now be described by way of example with reference to the accompanying Figures, of which.

DETAILED DESCRIPTION OF THE EMBODIMENT(S)

In the following, the invention is explained in greater detail with reference to the accompanying drawings, in which exemplary advantageous embodiments are shown. The shown advantageous developments and embodiments are independent from one another and can be combined arbitrarily according to the application.

Figure 1:
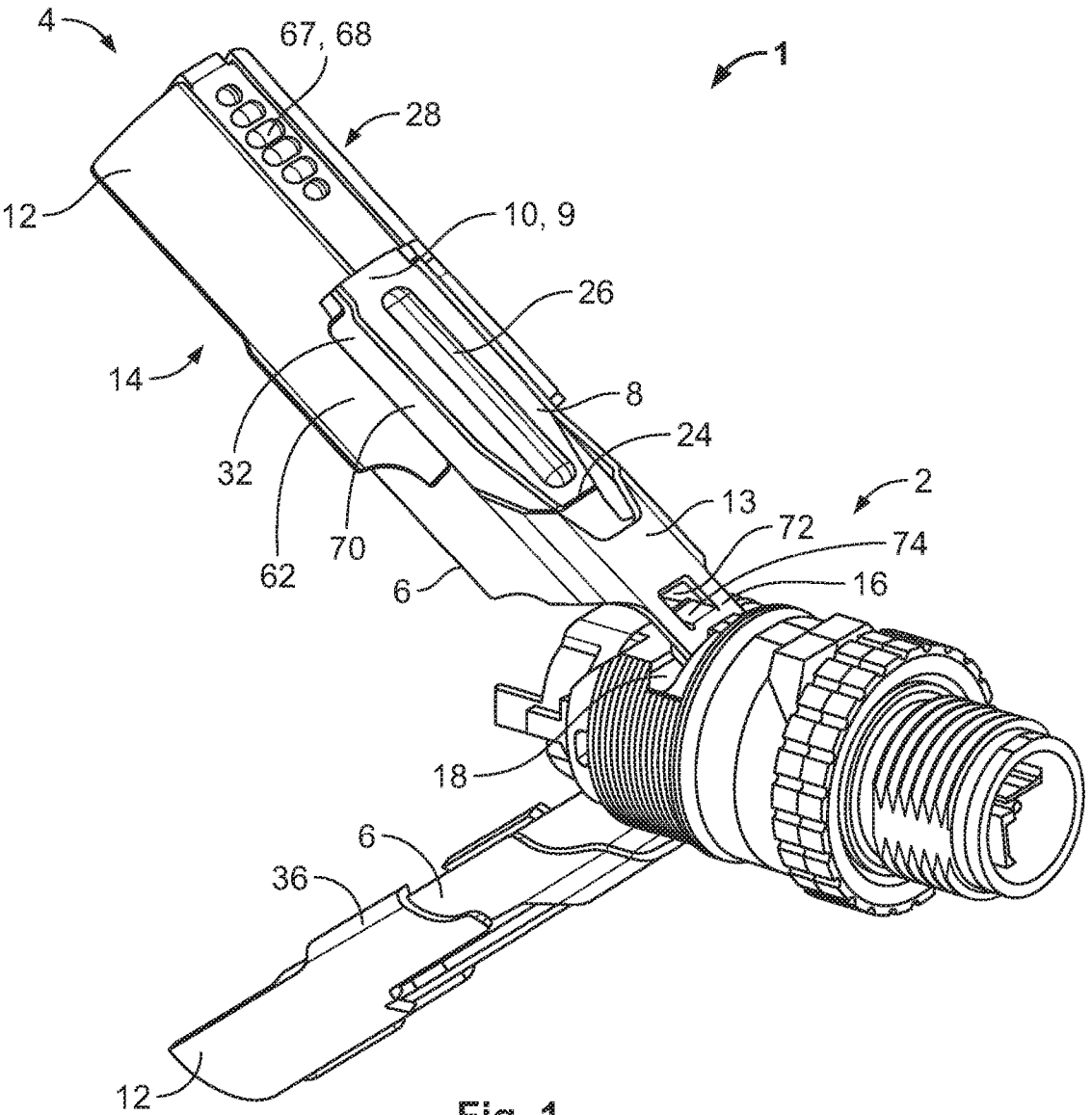
FIG. 1 is a perspective view of a connector according to an embodiment in an extended state.
Figure 2:
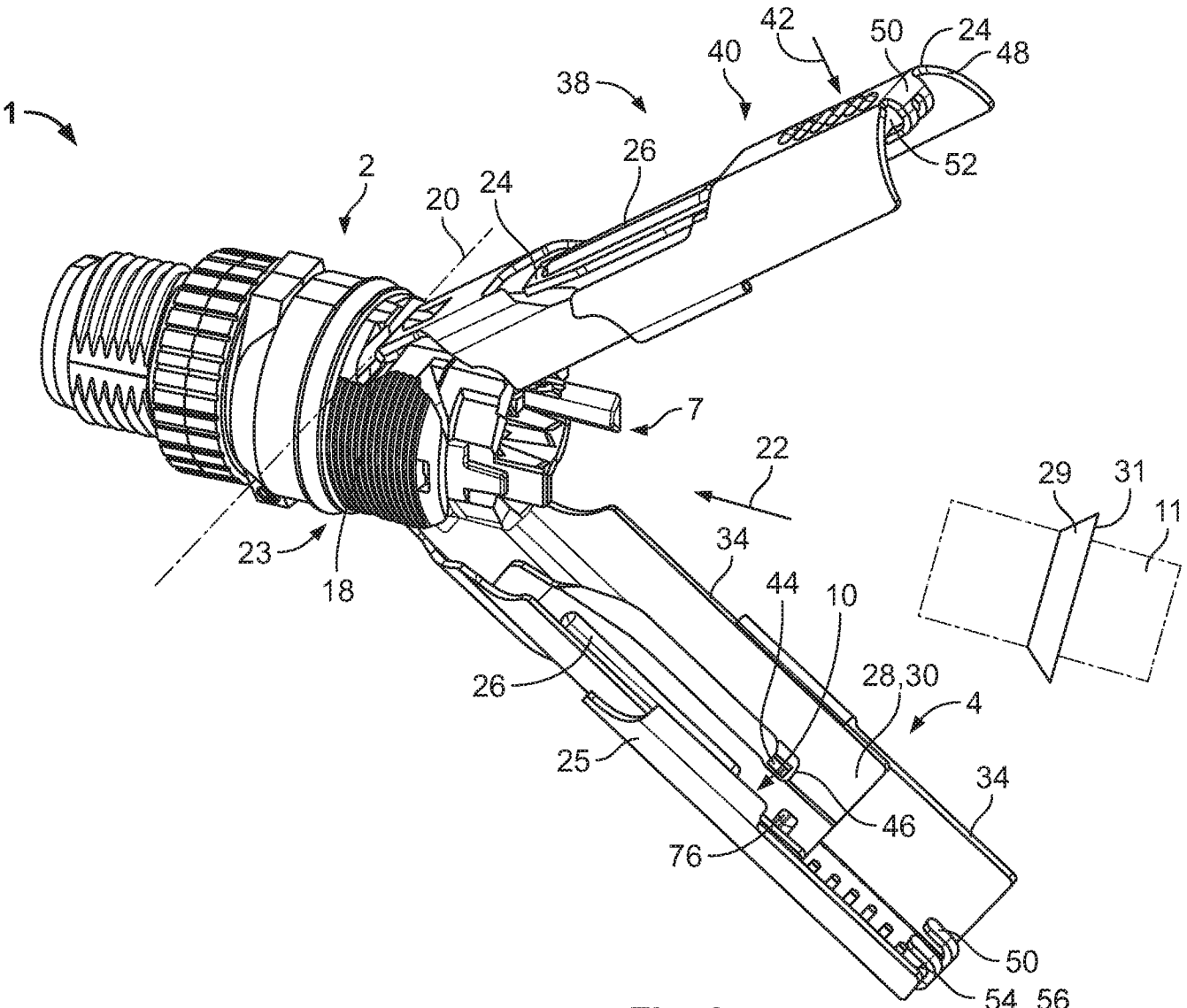
FIG. 2 is another perspective view of the connector in the extended state.

A connector 1 according to an embodiment, as shown in FIGS. 1 and 2, comprises a connector housing 2 and a lever assembly 4 with a pair of levers 6, which are arranged opposite one another on the connector housing 2. The connector housing 2 has on a coupling side 23 a socket 7, in which the complementary connector 11 that is schematically indicated in FIG. 2 can be inserted.

Each lever 6, as shown in FIG. 1, includes a coupling lever 8 with a necking 9 that forms a deformation zone 10 between the coupling lever 8 and the lever 6. The deformation zone 10 is an elastically deformable area with an increased flexibility relative to its immediate surrounding and serves to determine the place of deformation due to the force effect on the coupling lever 8 during coupling. The deformation zone 12 may comprise a lower material thickness compared to the rest of the coupling lever 8. Alternatively or additionally, the cross section of the coupling lever 8 in the deformation zone 12 may be lower compared to the point where the coupling lever 8 is attached to the lever 6.

The lever assembly 4 further comprises extensions 12 that are arranged on a side 13 of the lever 6 facing away from the opposing lever 6. As the levers 6 are structurally identical, the reference numerals in the figures are only shown in one of the two levers 6.

In an embodiment, the extension 12 is formed as removably and repeatedly attachable to the lever 6. The extension 12 may be a separate part from the lever 6. This opens up the possibility for easily exchanging the extension 12. Furthermore, the extension 12 may be attached if required to extend the lever 6 and may be detached afterwards so that the connector 1 takes up minimal space.

The figures show a monolithic embodiment of the lever 6 and the coupling lever 8. In a not shown embodiment, the coupling lever 8 may be pivotably attached via a hinge (not shown) to the lever 6. In another two part embodiment (not shown) the deformation zone 10 is not necessary. The lever assembly 4 shown in FIG. 1 and FIG. 2 show an open state 14, in which the levers 6 are arranged in a sharp angle to the socket 7. The coupling lever 8 is attached to the lever 6 at a point distance from an axis of rotation 20.

In an embodiment, the coupling lever 8 may be formed essentially planar. As a result the coupling lever 8 is flexible and may convert the force that is exerted onto the lever 6 into an axial force when coupled with the complementary connector 11. The coupling lever 8 thereby acts as a leaf spring that can be elastically deformed in the coupled state. If the coupling lever 8 is elastically deformed in the coupled state, a permanent force in coupling direction may keep the coupling between connector 1 and complementary connector 11.

As shown in FIGS. 1 and 2, the levers 6 are each mounted with a mounting portion 16 pivotable around an axis of rotation 20, which runs essentially perpendicular to the connection direction 22, in a reception pocket 18 of the connector housing 2. The levers 6 extend away from a coupling side 23 of the connector 1. In the mounting portion 16, the levers 6 have a guiding window 72 which is penetrated by a guide 74. Thereby, swivelling out sideways while pivoting the levers 6 is prevented.

As shown in FIG. 2, the coupling levers 8 each have a free end 24 that can be coupled with a complementary connector 11. The complementary connector 11 has a radially revolving protrusion 29. The free ends 24 of the coupling levers 8 can be fastened in the connection direction 22 to a side 31 of the radially revolving protrusion 29 facing away from the socket 7 so that the torque that is exerted by a force 42 on the lever arm 40 can be transmitted to the complementary connector 11 and be converted into an axial force that runs in the connection direction 22.

The coupling levers 8, as shown in FIGS. 1 and 2, each have a bulge 26 on a side 27 facing the opposing coupling lever 8 as well as on the side 13 facing away from the opposing coupling lever 8 that thickens the coupling lever 8. With the increased thickness due to the bulge 26, a deformation of the coupling lever 8 outside the deformation zone 10 may be prevented and thereby further increasing the form stability of the coupling levers 8. The bulge 26 may further function as an actuation surface for a user if the coupling lever 8 needs to be steered towards the complementary connector 11 for coupling with the complementary connector 11.

As shown in FIGS. 1 and 2, the levers 6 and the extensions 12 have a concave shape 28, wherein the concave side 30 of the levers 6 and the extensions 12 face essentially towards the opposing lever 6 and extension 12. Furthermore, the levers 6 each have a window 32 in which the coupling levers 8 are arranged. The extensions 12 have a fastening section 35 on their side edges 34 with guiding groove 36 that is in a hook shape deformed inwards towards the concave side 30, which each grasp a side edge 34 of the levers 6. The extensions 12 may be thereby attached to the levers 6 and may be pushed under guidance by the guiding groove 36 away from the connector housing 2 into the extended state 38, which is shown in FIG. 1 and FIG. 2, or into the not extended state 80, as shown in FIG. 3.

In the extended state 38, shown in FIGS. 1 and 2, the lever assembly 4 has longer lever arms 40. During coupling of the connector 1 with the complementary connector 11, a force 42 that is exerted onto the lever arm 40 may be transmitted by the coupling lever 8, which is at least coupled to the complementary connector 11 in the connection direction 22. The required force 42 decreases with an increasing length of the lever arm 40.

Figure 3:
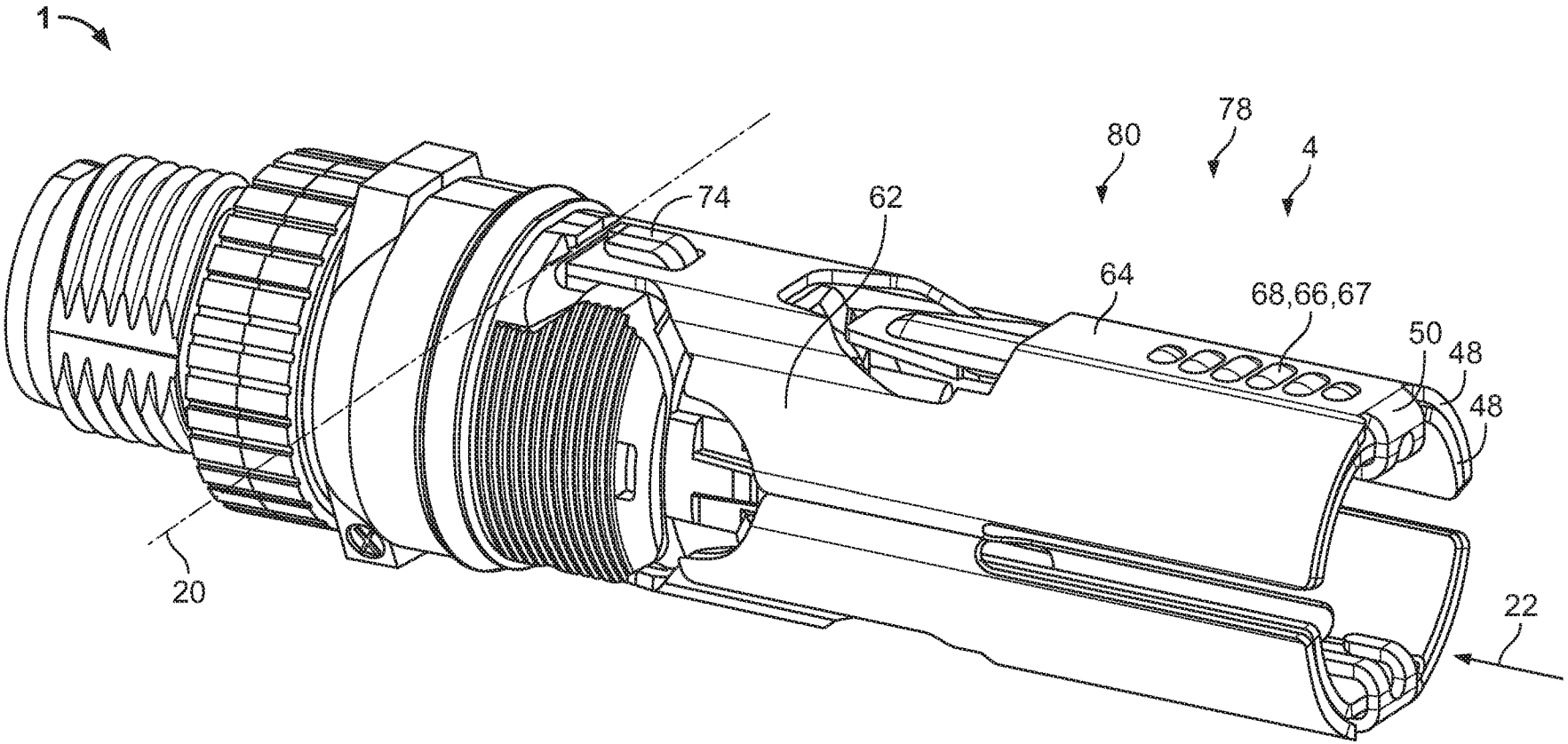
FIG. 3 is a perspective view of the connector in a not extended state.

The levers 6 are pivoted inwardly towards the connector housing 2 by the exerted force 42 until they are arranged essentially parallel to the connection direction 22 (see FIG. 3). In doing so the lever assembly 4 forms a jacket 58 that at least partially covers the socket 7 of the connector 1. On the concave side 30 the extensions 12 comprise on their proximal end 25 to the connector housing 2 catches 44 that protrude into the window 32 of the levers 6, as shown in FIG. 2. Thereby, the pulling out of the extensions 12 is limited, as the catches 44 abut the inner edge 46 of the window 32 in a maximally extended state 38.

As shown in FIG. 2, the extensions 12 have, on their outer edges 48, at their free ends 24 and distal to the connector housing 2, an essentially U-shaped stop 50 that extends towards the concave side 30 and whose opening 52 is directed towards the connector housing 2. The side 54 of the stop 50 located on the concave side 30 comprises a notch 56, in which a protuberance 76, which is positioned on the concave side 30 at the free end 24 of the lever 6, can be inserted.

The extensions 12 are formed with an essentially U-shaped cross section perpendicular to the connection direction 11, whereby the arms 62 are provided with the guiding grooves 36 that grasp the levers 6 and whereby the connection of the arms 64 form the free ends 24 of the extensions 12 and serve as a gripping surface 66, as shown in FIG. 3. On the gripping surface 66 a gripping aid 67, in the form of a riffle 68 that is arched outwardly on the side 13 facing away from the opposing lever 6, is formed. With the riffle 68, the grip increases and the extensions 12 can easily be slid in and out with only one finger. The cutout 70 between both the arms 62 and the extensions 12 enables an access of the coupling levers 8, which are arranged in the window 32.

In FIG. 3, the connector 1 shown in FIGS. 1 and 2 is depicted in a closed position 78. Furthermore, the lever assembly 4 is in a not extended state 80. The extensions 12 are retracted until the stop 50. The stops 50 each grasp the corresponding outer edges 48 of the levers 6. Thereby, the protuberances 76 are arranged in the corresponding notches 56 and latched thereto so that an unintentional moving out of extensions 12 can be prevented. The opposing extensions 12 abut each other with their guiding notches 36 and surround the socket 7 of the connector 1. In the not extended state 80, the lever assembly 4 only takes up a little space and may therefore be particularly suitable for applications which comprise a limited space and require a high insertion force.

The extension 12 may be latched with the lever 6 in the extended 38 and/or not extended state 80 of the lever assembly 4. With a latching, the extension 12 is held in the extended state 38 or not extended state 80, respectively, and an unintentional movement relative to the lever 6 is prevented. The latching may for example, but not exclusively, be realized by a projection that penetrates an opening in the extended state 38 or not extended state 80, respectively. In one embodiment, the projection can be arranged on the lever 6 and the extension 12 may comprise an opening. In another embodiment, the extension 12 may comprise the projection and the lever 6 the opening, in which the projection is latched in at least one state.

In another embodiment, the extensions 12 may each comprise a hook that interlock with one another in the closed position 78 and thereby prevent a pivoting movement of the lever assembly 4. Furthermore, the coupling between the connector 1 and the complementary connector 11 may be secured by the lever assembly 4.

In an embodiment, the extension 12 may be folded out at a maximum of 180° so that the lever arm 40 is extended linearly and that the extension 12 is not further folded outwards by an impact of force and the force is transmitted to the lever 6. Alternatively the lever assembly 4 may comprise a lock that locks the extension 12 in a folded out state. The angle in which the extension 12 may be folded out may be thereby configured freely by the user depending on the conditions. After the locking, the force that is exerted onto the extension 12 will be transmitted to the lever 6 and eventually to the coupled complementary connector 11.

In an embodiment, the lever 6 and the extension 12 may form a telescopically retractable assembly. Alternatively or additionally, the extension 12 or the lever 6 may have a cavity, in which the lever 6 and extension 12 may be at least partially inserted in the not extended state 80, respectively.

The lever assembly 4 may at least partially be curved around the connection direction 22, as shown in FIG. 3. In at least one position, the lever assembly 4 may function as a housing that covers the coupling section as well as at least partially the complementary connector 11 in a coupled arrangement and protect it from outer influence attacking radially to the connection direction 22.

Figure 4:
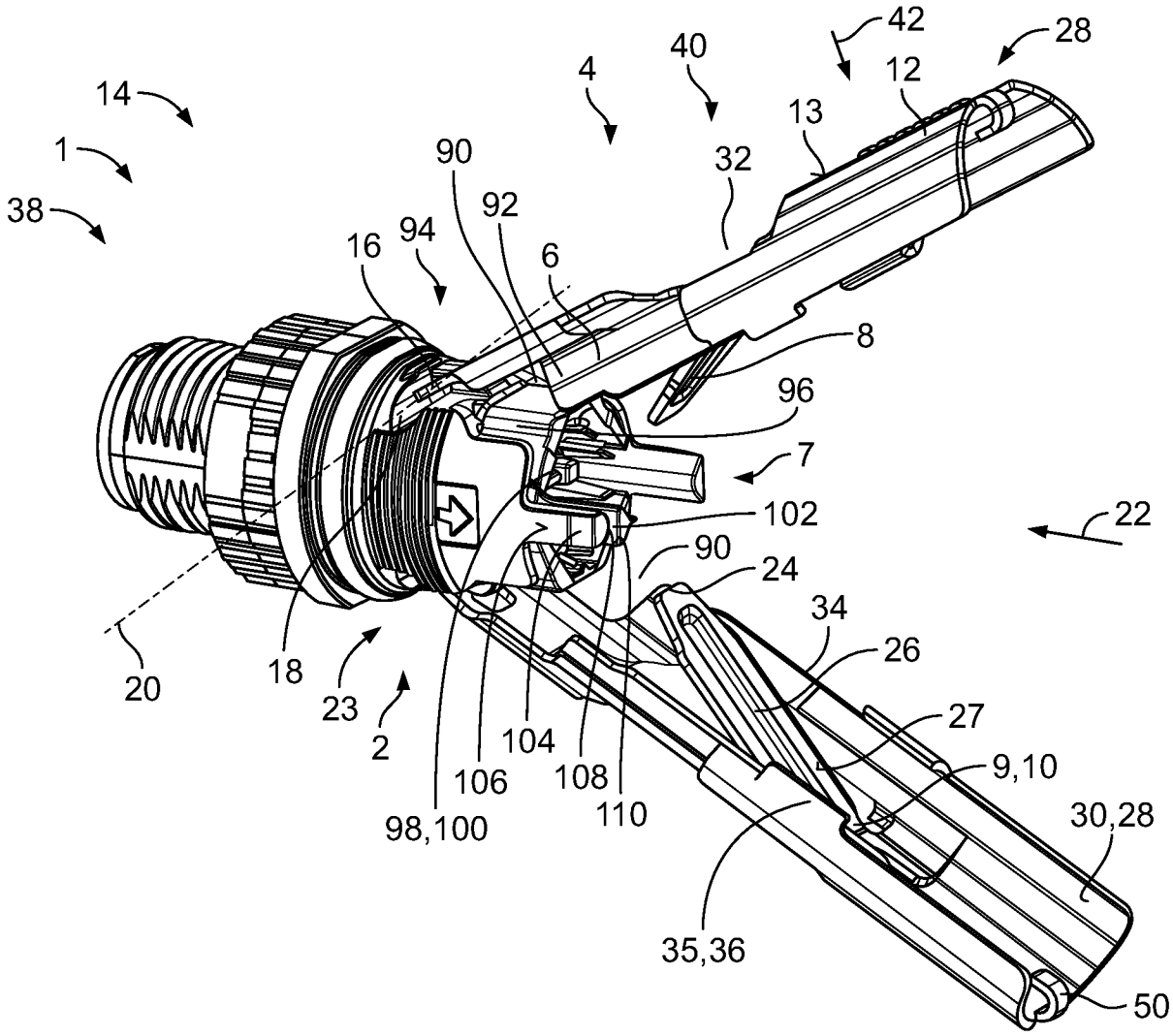
FIG. 4 is a perspective view of a connector according to another embodiment.

In FIG. 4, a second embodiment of an inventive connector 1 is shown. In comparison to the first embodiment, the levers 6 comprise a recess 90 at lateral sides 92 of the levers 6, i.e. the sides adjacent to the peak of the curved shape. The recess 90 is provided at a proximal end 94 of the respective lever 6 proximal to the axis of rotation 20. In the closed position 78, in which the lever 6 extends along the connection direction 22 in the direction of the coupling side 23 away from the axis of rotation 20, a gap (see FIG. 6 or FIG. 7) may be provided that extends between the levers 6 and the connector housing 2 in the connection direction 22.

The connector housing 2, as shown in FIG. 4, may at least partially receive a ring shaped inner housing 96 in the socket 7. The inner housing 96 may be formed from an electrically insulating material such as a ceramic material and/or a resin and may comprise at least one cutting blade 98 for cutting at least one wire of the complementary connector 11 to length during insertion of the complementary connector 11 into the socket 7. The ring shaped inner housing 96 comprises the form of an octagon, wherein the at least one cutting blade 98 is formed by the inner edge 100 of the inner housing 96 facing the complementary connector 11. In this exemplary embodiment, the inner housing 98 comprises eight cutting blades 98, wherein the cutting blades 98 are arranged in pairs on alternating sides of the octagon. In other words, every second side of the octagon comprises two cutting blades 98. The cutting blades 98 may be formed by a ceramic material or may even be formed as metal blades. In this case, an insulating feature may be provided ensuring that the at least one wire may be electrically insulated when the complementary connector 11 is connected to the connector housing 2.

The inner housing 96 has at least one guiding feature 102 extending in the connection direction 22 away from the socket 7 adapted to be inserted into a guiding slot of the complementary connector 11, as shown in FIG. 4. The guiding feature 102 extends from a side of the octagon that is not provided with a cutting blade 98 and codes the connector 1 so that the complementary connector 11 can only be inserted in a predetermined rotational position relative to the connector 1. In this exemplary embodiment, two guiding features 102 are provided arranged diametrically to one another.

The connector housing 2 further comprises two stabilizing posts 104, shown in FIG. 4, that extend parallel to the guiding features 102 for stabilizing the guiding features 102. If a force is exerted onto the guiding features 102, a deflection of the guiding features 102 in the radial direction is prevented by the stabilizing posts 104. At least the stabilizing posts 104 may be formed by die casting and may comprise a robust material such as a metal. Alternatively, the connector housing 2 may be formed by die casting. The connector housing 2 and the at least one stabilizing post 104 may be formed integral with one another. The material thickness of the connector housing 2, in particular the stabilizing posts 104 in radial direction is such that an outer surface 106 of the connector housing 2, in particular of the stabilizing posts 104, is essentially flush with the outer circumference of the lever assembly 4 in the closed position 78. Therefore, it is ensured that the connector housing 2, especially the stabilizing posts 104 is robust and rigid enough to prevent any deformation to the inner housing 96 and/or the connector housing 2 itself.

Due to the recess 90 of the levers 6, it is possible for the connector housing 2, especially the stabilizing posts 104, to further extend along the connection direction 22, increasing the depth of the socket 7 and further encasing the inner housing 96 along the connection direction 22. Thus, as the inner housing 96 is inserted deeper into the connector housing 2, the stabilization of the inner housing 96 by the connector housing 2 is further increased.

The guiding features 102, as shown in FIG. 4, have a depression 108 on their radially outwards facing surface 110 and the stabilizing posts 104 may nestle in the corresponding depression 106 so that the stabilizing posts 104 do not only stabilize the guiding features 102 in the radial direction, but also in a circumferential direction. Hence, due to the robust stabilizing posts 104 with a high material thickness, a stable connection between the connector 1 and the complementary connector 11 can be formed even with an asymmetrical insertion force distribution.

Figure 5:
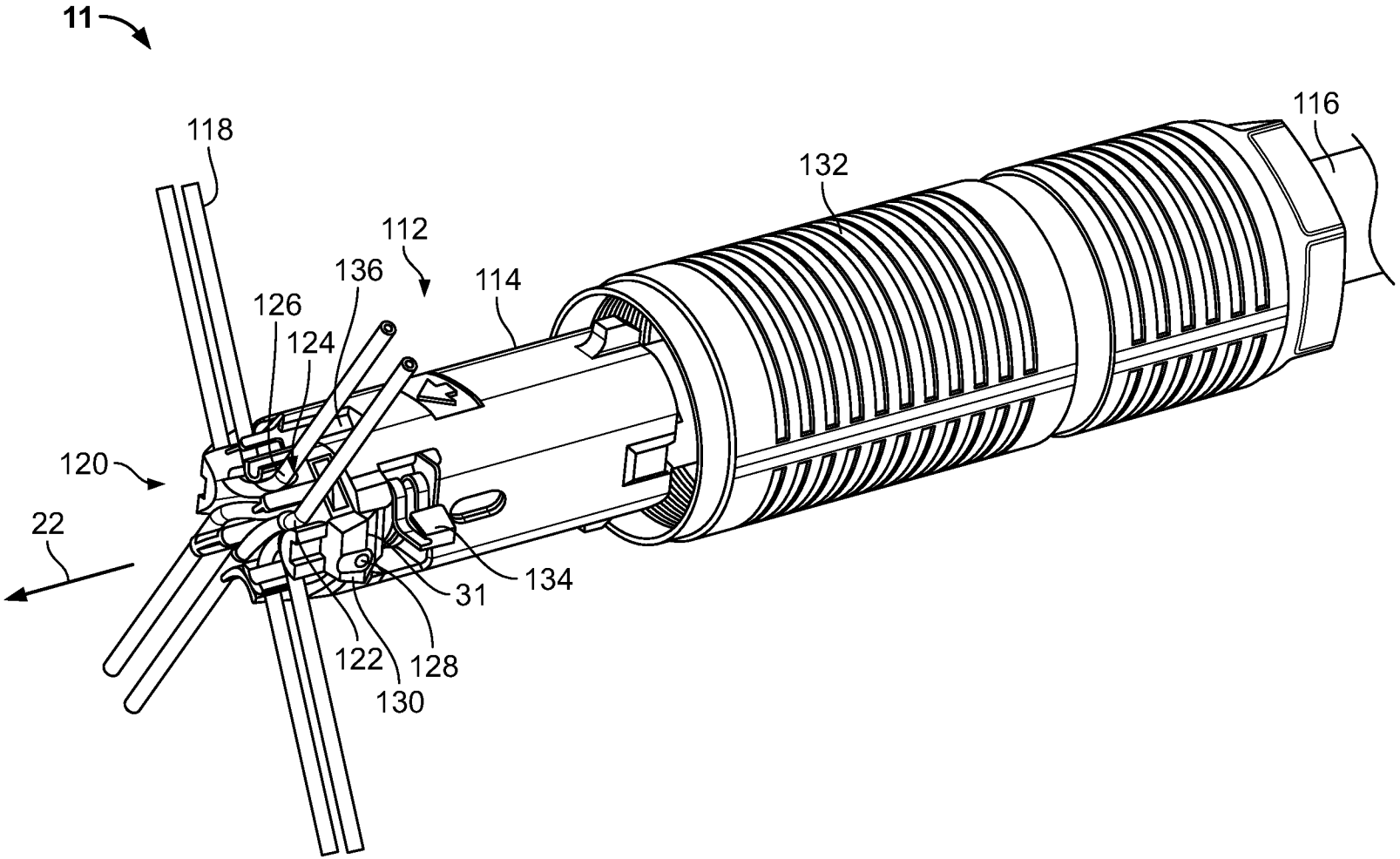
FIG. 5 is a perspective view of a complementary connector of a connector assembly according to an embodiment.

In FIG. 5, an exemplary embodiment of a complementary connector 11 is shown in a schematic perspective view. The complementary connector 11 is formed as a wire manager 112 that extends along the connection direction 22. The wire manager 112 is formed as a hollow tubular body 114. A cable 116 can be inserted into the hollow body 114 in the connection direction 22. The cable 116 has at least one wire 118 that protrudes from the hollow body 114 in the connection direction 22 and is arranged on an end face 120 of the wire manager 112 arranged perpendicular to the connection direction 22. The end face 120 is adapted to hold the at least one wire 118 at a predetermined position and is adapted to be inserted into the inner housing 96. In this exemplary embodiment, the cable 116 comprises four pairs of twisted wires 118. However, different embodiments are also possible, in particular cables comprising two pairs of twisted wires 118. The end face 120 is formed complementary to the inner housing 96 and the pairs of twisted wires 118 are arranged opposite to the pairs of cutting blades 98, i.e. on every second side of the octagon a pair of twisted wires 118 can be arranged. Thus, the pairs of twisted wires may be arranged in a symmetrical cross formation. However, if the cable 116 comprises only two pairs of twisted wires 118, it is also possible to arrange the pairs of twisted wires 118 asymmetrically, i.e. the two pairs are not arranged diametrically to one another.

The end face 120, as shown in FIG. 5, has wire holders 122 for holding and securing the wires 118 on the end face 120. The wire holders 122 are formed as essentially U-shaped seats 124, wherein the wires 118 can be inserted into the slots 126 of the corresponding seats 124, so that the wires 118 are arranged essentially perpendicular to the connection direction 22. The wires 118 protrude radially from an edge 127 of the end face 120. The protruding part of the wires 118 have to be cut off during the insertion of the end face 120 into the inner housing 96, as is explained in detail later with reference to FIGS. 6 and 7.

The complementary connector 11 has at least one shielding contact 128, as shown in FIG. 5, that contacts a braided and/or foiled shield of the cable 116. The shielding contact 128 is radially and elastically deflectable and lies at least partially on a pedestal 130 radially protruding from the hollow body 114. The shielding contact 128 may thus contact a shell 132 that can be slid over a coupling section of the connector assembly, for a 360° shielding.

In addition to the at least one shielding contact 128, the complementary connector 11 has at least one elastically and/or radially deflectable secondary shielding contact 134 that may at least partially be wrapped around the braided and/or foiled shield of the cable 116. The at least one secondary shielding contact 134 may be formed so that the lever assembly 4 abuts the secondary shielding contact 134 and presses the secondary shielding contact 134 against the braided and/or foiled shield of the cable 116 so that a planar distributed contact of the braided and/or foiled shield of the cable 116 is achieved. The at least one secondary shielding contact 134 can be connected to the shell 132 via the lever assembly 4.

As shown in FIG. 5, the wire manager 112 is further provided with guiding slots 136 formed complementary to the guiding features 102 so that the guiding features 102 can be received in the guiding slots 136 during establishing the connection between the connector 1 and the complementary connector 11.

Figure 6:
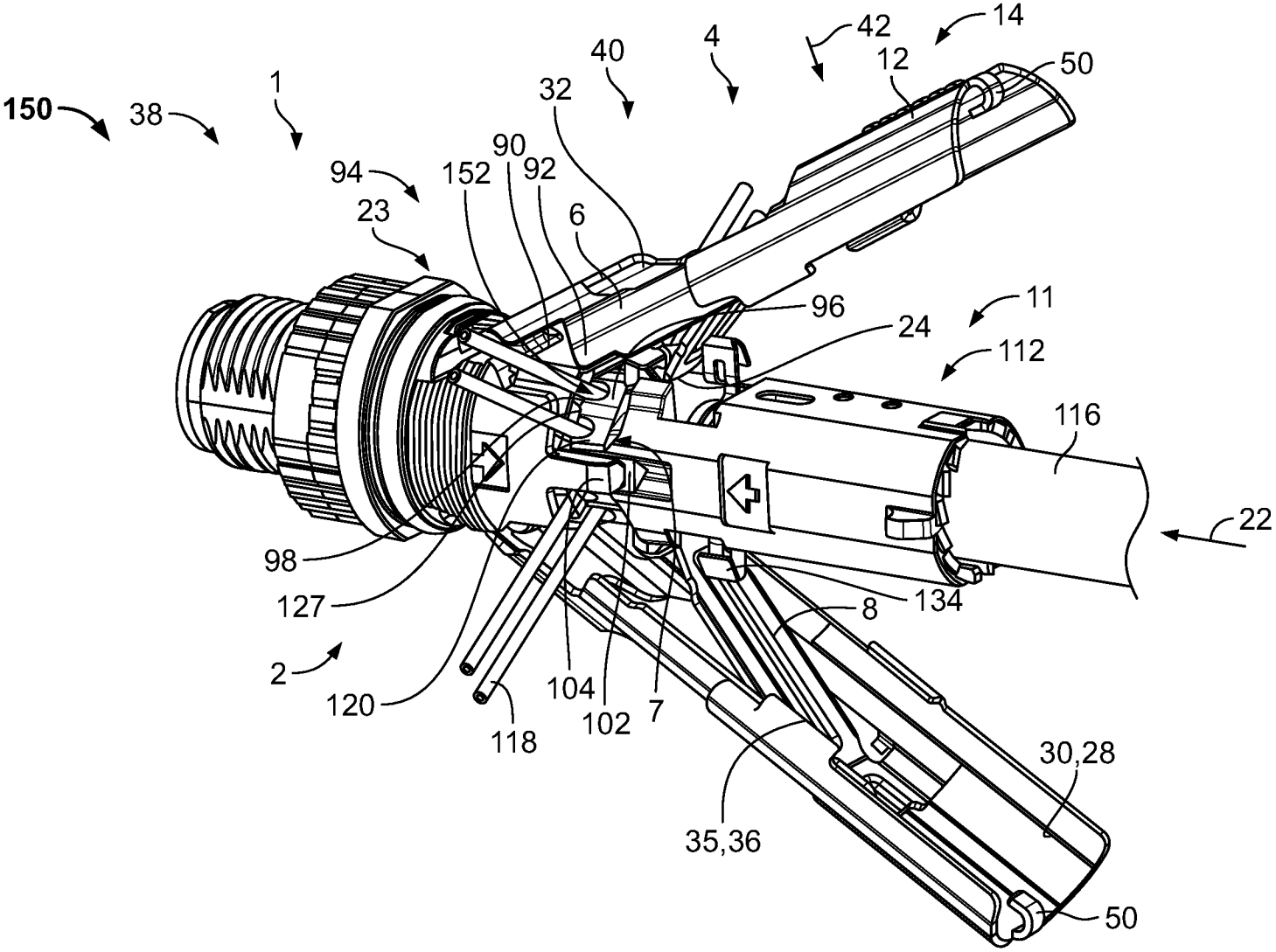
FIG. 6 is a perspective view of the connector assembly with the complementary connector inserted into the connector.
Figure 7:
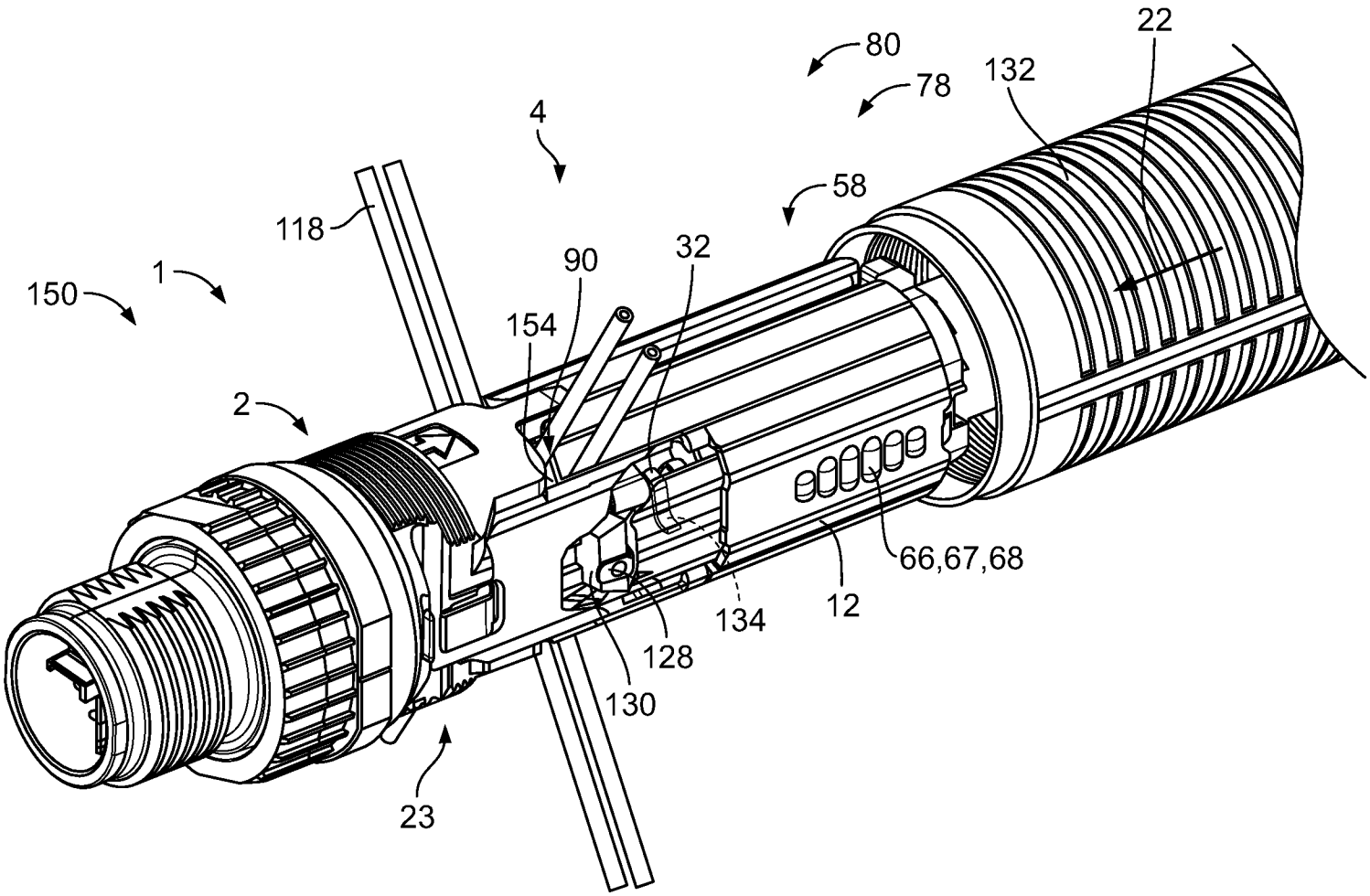
FIG. 7 is a perspective view of the connector assembly with the connector closed around the complementary connector.

The function and interaction between the connector 1 and the complementary connector 11 is now explained with reference to FIGS. 6 and 7. FIGS. 6 and 7 show a schematic perspective view of a connector assembly 150 according to the invention. The exemplary embodiment shown of the connector assembly 150 shown in FIGS. 6 to 8 comprises an inventive connector 1 as described with reference to FIG. 4 and a complementary connector 11 as described with reference to FIG. 5.

In FIG. 6, the connector 1 is shown wherein the lever assembly 4 is in an opened position 14, i.e. the levers are not arranged essentially parallel to the connection direction 22. As can be seen in FIG. 6, the end face 120 of the complementary connector 11 needs to be inserted into the inner housing 96. However, the wires 118 protrude from the edge 127 of the end face 120 and need to be cut to length during insertion. Therefore, the axial insertion force—needed to couple the connector 1 with the complementary connector 14—is further increased. This might, in particular, be problematic in tight spaces, in which the user is not able to provide the necessary force for coupling the connector 1 and the complementary connector 11.

In order to provide a connector 1, wherein the coupling with the complementary connector 11 with low force and low space requirements, the connector 1 comprises the lever assembly 4 comprising at least one lever 6 with the movable extension 12 attached thereto. Due to the extended lever arm 40 the lower force 42 is necessary to create a torque, which can be converted into the axial force for coupling the connector 1 to the complementary connector 11.

The free ends 24 of the coupling levers 8 abut and/or are latched to the side 31 of the pedestals 130 facing away from the socket 7 and are thus coupled to the complementary connector 11. By exerting the force 42 onto the extensions 12 the levers 6 are pivoted around the axis of rotation 20 until the levers 6 are arranged essentially parallel to the connection direction 22. During this movement, the coupling levers 8 push the complementary connector 11 in the connection direction 22 inserting the end face 120 into the socket 7.

The edge 127 forms a shearing assembly 152 together with the cutting blades 98, shown in FIG. 6. The edge 127 glides past the cutting blades 98 so that the excessive length of the wires 18 is sheared off.

A radial deformation of the inner housing 96 may be prevented by the connector housing 2. In particular, the stabilization posts 104 prevent a radial and/or circumferential deflection of the guiding features 102 so that a tilting or torsion of the complementary connector 11 can be prevented. This is in particular of relevance, when the wires 118 are not symmetrically arranged on the end face 120 due to desired termination configurations. For example, the cable 116 may comprise two pairs of twisted wires 118, wherein the pairs are positioned in an ortho- or meta-arrangement. Hence, the complementary connector 11 may tilt towards the opposing side without the pairs of twisted wires due to less resistance. However, this tilting movement may be prevented with the stabilizing posts 104 pressing against the guiding features 102. The stabilizing post 104 may be formed of a rigid material with high robustness, such as a metallic die cast piece.

During pivoting the levers 6 into the closed position 78, shown in FIG. 7, the secondary shielding contact 134 abuts the coupling lever 8 and is pressed against the braided and/or foiled shield of the cable 116. The lever assembly 4 is formed by an electrically conductive material in an embodiment. The protruding part of the wires 118 is subsequently cut off once the lever assembly 4 is in the closed position 78 and the connector 1 and complementary connector 11 are successfully coupled. However, due to the elasticity of the wire insulation, the cut off part of the wires 118 does not simply fall off from the connector assembly 150. Rather, they are still attached to the connector assembly 150 and have to be removed manually by hand and/or with a tool, e.g. pliers (see FIG. 7).

In the connector 1, as shown in FIG. 7, a gap 154 is formed that extends between the lever assembly 4 and the connector housing 2, in particular between the lever assembly 4 and the inner housing 96. The gap 154 is formed due to the recess 90 of the lever assembly 4 and may at least partially run along the circumference of the lever assembly 4. The width of the gap 154 between the lever assembly 4 and the inner housing 96 in the connection direction 22 is greater than the diameter of the wire 118 intended for use in such a connector assembly 150.

As shown in FIG. 7, the wires 118 are arranged so that they radially protrude through the gap 154. This can be achieved by having the wire holders 122 open into the gaps 154 right before insertion into the inner housing 96. Hence, the cut off part of the wires 118 may protrude from the gap 154 without bending the wires 118 and thus may easily be plucked off by hand and/or with a tool. It is thus not necessary to pivot the levers 6 into an open position and decouple the connector 1 and complementary connector 11 from one another in order to remove the cut off parts of the wires 118.

As can be seen in FIG. 7 in the at least one position, i.e. the closed position 78, the pedestal 130 protrudes through the window 32 so that the shielding contact 128 which is partially arranged on the pedestal 130 extends beyond the outer circumference of the lever assembly 4 in the closed position 78. The secondary shielding contact 134 is pressed against the braided and/or foiled shield by the coupling lever 8. The lever assembly 4 is formed by an electric conductive material, so that the lever assembly 4 electrically couples the secondary shielding contact 134 with the outer shell 132 that can be slid over the coupling section of the lever assembly 4. The shielding contact 128 may directly contact the outer shell 132.

In the closed position 78 shown in FIG. 7, the extensions 12 can be moved back so that the lever assembly 4 is in the not extended state 80 and thus does not take up a lot of space. The cut off wires 118 can be plucked off without needing to open the lever assembly 4, and the outer shell 132 can be slid over the coupling section of the connector assembly 150 and secured by a threaded connection to the connector housing 2 shielding the connector assembly 150, protecting the coupling section from outer influence and further blocking the levers 6 to pivot out of the closed position 78. The outer shell 132 may comprise features for strain relief.

The connector 1 and/or the connector assembly 150 that also allows a simple coupling with low physical effort even in limited space, that is easily produced, and that takes up as little space as possible in the coupled state. With the connector 1 and/or connector assembly 150, a high axial force can be achieved by the user even in limited space, as the lever arm 40 can be extended by the extension 12. With the longer lever arm 40, a higher torque, which can be converted into a high axial force in the coupling direction 22 during coupling with a complementary connector 11, can be achieved with lower physical effort. In the not extended state 80, the lever assembly 4 only takes up a little space. Thus, the inventive connector 1 is particularly suitable for a coupling with minimal space.

What is claimed is:

1. A connector, comprising:

a connector housing having a coupling side for coupling with a complementary connector along a connection direction; and a lever assembly including:

a lever for coupling with the complementary connector, the lever is pivotable around an axis of rotation on the connector housing, the axis of rotation extends essentially perpendicular to the connection direction, the lever extends in at least one position in the connection direction away from the axis of rotation toward the coupling side;

an extension that is movable relative to the lever and that extends the lever assembly in an extended state away from the axis of rotation; and a coupling lever for selectively coupling with the complementary connector, the coupling lever in the at least one position is rotatable relative to the lever toward the connector housing.

2. The connector of claim 1, wherein the extension is latched with the lever in an extended state and/or in a not extended state of the lever assembly.

3. The connector of claim 2, wherein the extension is arranged in the at least one position in the not extended state at a side facing away from the connector housing.

4. The connector of claim 1, wherein the extension is slidably attached to the lever.

5. The connector of claim 1, wherein the lever and the extension form a telescopically retractable assembly.

6. The connector of claim 1, wherein the lever assembly includes a stop limiting movement of the extension relative to the lever.

7. The connector of claim 1, wherein the lever and/or the extension extend around the connection direction in the at least one position.

8. The connector of claim 1, wherein the extension has a hook-shaped fastening section engaging a side edge of the lever.

9. The connector of claim 1, wherein the extension has an outwardly curved gripping surface with a gripping aid.

10. The connector of claim 1, wherein the coupling lever in the at least one position is pivotable relative to the lever toward the connector housing.

11. The connector of claim 10, wherein the lever assembly has a window in which the coupling lever is arranged in the at least one position.

12. The connector of claim 10, wherein the coupling lever has a bulge that thickens the coupling lever.

13. The connector of claim 10, wherein the coupling lever is at least partially covered by the extension in a not extended state of the lever assembly.

14. The connector of claim 1, wherein the lever assembly includes a locking mechanism for preventing pivoting of the lever assembly.

15. The connector of claim 1, wherein the connector housing is at least partially covered by the lever assembly in the at least one position.

16. The connector of claim 1, wherein the connector housing has a stabilizing post extending at the coupling side along the connection direction, the stabilizing post stabilizing the complementary connector in a radial direction.

17. The connector of claim 16, wherein the stabilizing post is essentially flush with an outer circumference of the lever assembly in the at least one position.

18. The connector of claim 1, wherein a gap is disposed at least partially between the connector housing and the lever assembly in the at least one position.

19. The connector of claim 18, wherein the gap is greater in width in the connection direction than a wire used with the connector.

20. A connector, comprising:

a connector housing having a coupling side for coupling with a complementary connector along a connection direction; and a lever assembly including a lever for coupling with the complementary connector, the lever is pivotable around an axis of rotation on the connector housing, the axis of rotation extends essentially perpendicular to the connection direction, the lever extends in at least one position in the connection direction away from the axis of rotation toward the coupling side, the lever assembly has an extension that is movable relative to the lever and that extends the lever assembly in an extended state away from the axis of rotation, wherein the extension is formed removably and repeatedly attachable to the lever.

21. A connector assembly, comprising:

a complementary connector with an end face; and a connector including a connector housing having a coupling side facing the end face, the complementary connector is at least partially inserted into the connector housing in a connection direction, and a lever assembly including a lever for coupling with the complementary connector, the lever is pivotable around an axis of rotation on the connector housing, the axis of rotation extends essentially perpendicular to the connection direction, the lever extends in at least one position in the connection direction away from the axis of rotation toward the coupling side, the lever assembly has an extension that is movable relative to the lever and that extends the lever assembly in an extended state away from the axis of rotation, the lever assembly further including a coupling lever having a first end coupling with the complementary connector and a second end attached to the lever, the coupling lever in the at least one position is movable relative to the lever toward the connector housing.

22. The connector assembly of claim 21, wherein the complementary connector has a wire holder holding a wire perpendicular to the connection direction, the wire holder opens into a gap in an opened position before insertion of the end face into the connector housing.

23. The connector assembly of claim 21, wherein the complementary connector has an elastically and/or radially deflectable shielding contact adapted to contact a shield of a cable, the shielding contact protruding from a window of the lever assembly in the at least one position.

24. The connector assembly of claim 23, wherein the complementary connector has an elastically and/or radially deflectable secondary shielding contact adapted to contact the shield of the cable, the secondary shielding contact abutting the lever assembly in the at least one position.

* * * * *